United States Patent [19]

Meis

[11] 3,955,397

[45] May 11, 1976

[54] APPARATUS FOR PULLING DEFORMATIONS FROM SHEET METAL AND METAL FRAMES OF VEHICLES AND THE LIKE

[76] Inventor: William J. Meis, 3632 Camerino, Lakewood, Calif. 90712

[22] Filed: Apr. 29, 1974

[21] Appl. No.: 465,295

[52] U.S. Cl. ..... 72/442; 72/705

[51] Int. Cl.[2] ..... B21D 1/12

[58] Field of Search ..... 72/705, 442; 254/163, 254/164, 51

[56] References Cited

UNITED STATES PATENTS

| | | | |
|---|---|---|---|
| 1,185,425 | 5/1916 | Miller | 254/163 |
| 3,120,370 | 2/1964 | Sause, Jr. | 254/164 X |
| 3,340,720 | 9/1967 | Chartier | 72/705 X |
| 3,492,855 | 2/1970 | Wylie | 72/705 |
| 3,589,680 | 6/1971 | Kuhn | 72/705 X |
| 3,612,482 | 10/1971 | Eck | 72/705 |
| 3,630,066 | 12/1971 | Chisum | 72/705 X |
| 3,679,175 | 7/1972 | Drayton | 254/51 |
| 3,754,432 | 8/1973 | Hagerty | 72/705 X |
| 3,835,692 | 9/1974 | Hoffman | 72/705 X |

FOREIGN PATENTS OR APPLICATIONS

| | | | |
|---|---|---|---|
| 265,262 | 2/1927 | United Kingdom | 254/164 |

*Primary Examiner*—C. W. Lanham
*Assistant Examiner*—D. M. Gurley
*Attorney, Agent, or Firm*—I. Morley Drucker

[57] ABSTRACT

This invention relates to an improved apparatus for pulling deformations out of sheet metal and metal frames of automobiles, and other vehicles or other items having metal parts.

The improvements are directed towards chain pulley assemblies, through which pulling chains travel. The chain pulley assemblies allow locking of the pulling chain within the tracks of the pulley assemblies, prevent loss of pull on one chain assembly, even though the pull angle is changed on another chain assembly during the course of the pull, and permit two or more individual controlled pulls to be accomplished at the same time.

6 Claims, 5 Drawing Figures

APPARATUS FOR PULLING DEFORMATIONS FROM SHEET METAL AND METAL FRAMES OF VEHICLES AND THE LIKE

BRIEF SUMMARY OF THE INVENTION

This invention relates to an improved apparatus for pulling deformations out of sheet metal and metal frames of automobiles, and other vehicles or other items having metal parts.

The apparatus comprises a stable anchored post and an extensible pulling post telescopically mounted within the anchored post and operatively connected to a pneumatic or hydraulic powered ram. The pulling post has a pulling head mounted on the top thereof. Two or more spaced chain pulley assemblies are stably mounted, and independently and precisely positioned, on the anchored post.

Two or more gripper means grip the part to be straightened. Chains, made of a series of welded links act as the pulling means and one end of each chain is stably attached to each of the gripping means. Each chain then passes around each of its chain pulley means, and the remaining end of each chain is attached to the pulling head of the pulling post.

Pressure from the ram then forces the pulling post upwardly, and the chains transmit the pulling force, exerted by the upward extension of the pulling head, to the part which has been damaged and thereby pull the damaged area into a desired form.

The major advantages of the apparatus of this invention are that:

1. Two or more individually controlled and continuous pulls can be accomplished at the same time. Each of the pulls can be made at precisely the right angle because the height and direction of each pulley assembly is individually and independently controlled.

2. Each chain pulley assembly includes means for automatically locking the chain as it travels through the pulley assembly to avoid any loss of pull.

3. Each chain assembly has especially designed pockets or tracks for the chain links to prevent the chain from jumping out of the pulley assembly and thus minimize chain damage.

4. Since each chain pulley assembly automatically locks the chain, as it travels through the pulley during the pull, the operator can hold a pull with one chain while changing the other chain to a completely different height and/or direction.

5. The pulling head, attached to the pulling post, is designed to allow fast removal of chain slack while the chain pockets mentioned earlier, prevent the chain links from jumping out of the pulley assembly.

DETAILED DESCRIPTION OF THE INVENTION

Figure 1:
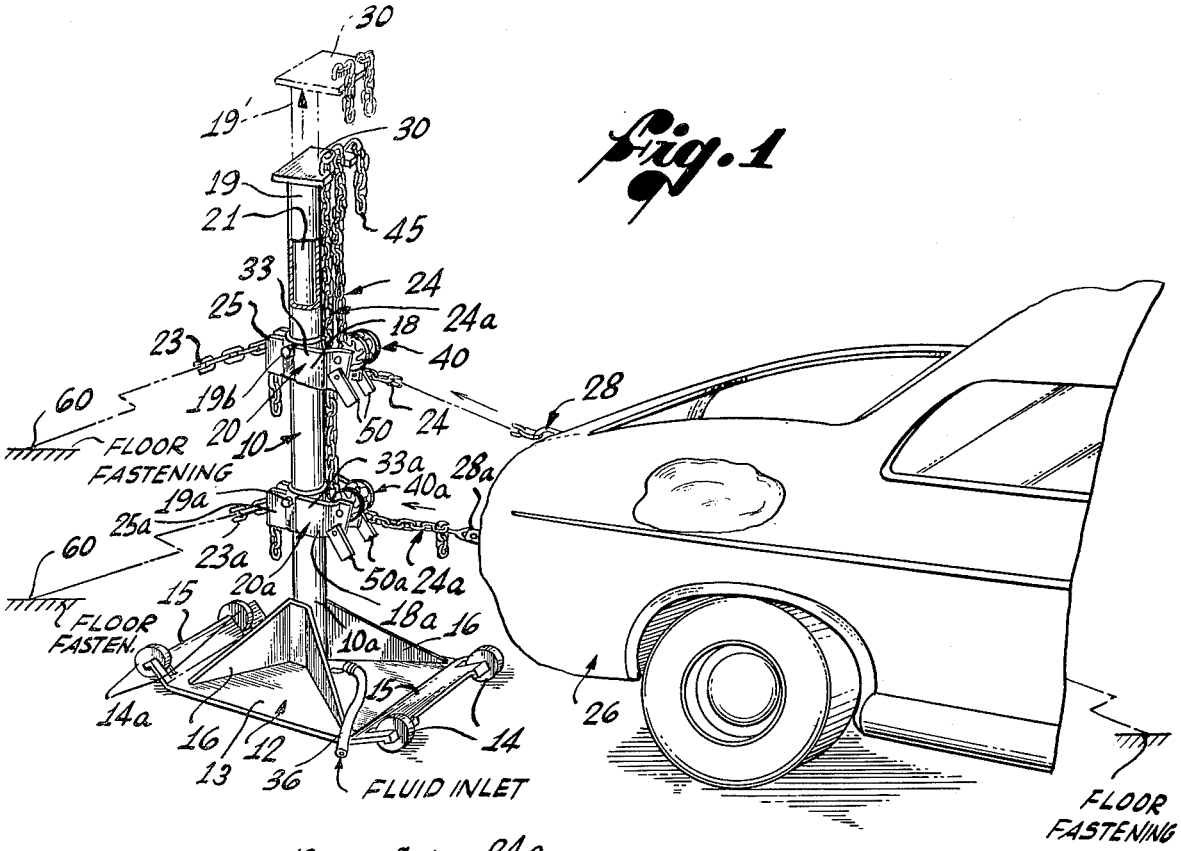
FIG. 1 is a perspective view of the improved apparatus for pulling deformations out of sheet metal and metal frames of automobiles.

The apparatus of my invention comprises a stably anchored tubular metal post 10, to which is welded an enlarged metal base 12. The enlarged base 12 includes a substantially flat, normally horizontally disposed, central base metal plate 13 to which is welded generally vertical, reinforcing metal fillets 16, a central portion of each fillet 16 being welded to the lower part 10*a* of the post 10, as indicated in FIG. 1. At opposed ends of the flat central base plate 13, and preferably integral therewith, are provided upwardly angled flanges 15, the flanges 15 having rotatably mounted therein two pairs of wheels 14, 14*a*. The wheels 14, 14*a* do not touch the floor when the central base plate 13 is substantially horizontally disposed and resting on the floor. However, when the apparatus is to be moved, the post 10 need only be tipped until one pair of wheels 14 and 14*a* touches the floor, and the apparatus is then easily moved to the desired spot. All parts of the apparatus, except for the wheels, are preferably made of high strength metal or metal alloy.

The tubular anchor post 10 is provided with a vertically extensible, pulling post 19 telescopically mounted within the anchor post 10. The pulling post 19 is operatively connected to a pneumatic or hydraulic powered ram 21, the fluid power source for the ram being provided by fluid inlet 36 communicating directly with the ram 21 and thereby preventing powering the ram. The maximum stroke of the ram 21 preferably ranges between about 6 inches to 10 inches. The pulling post 19 has a pulling head 30 welded thereto.

A pair of spaced, chain pulley assemblies 20, 20*a* are stably mounted and independently and precisely positionable onto the anchored post 10. Each of the pulley assemblies 20, 20*a* includes main pulley brackets 18, 18*a*, respectively, each bracket being independently slidably movable either up or down on post 10, and being also rotatable about post 10. Each main chain pulley bracket 18, 18*a* can be tightly fixed to post 10 by a plurality of set screws 19*b*, 19*a* so that the height and direction of the pulling chains passing through the chain pulley assemblies 20, 20*a* can be fixed.

Each of main pulley brackets 18, 18*a* are further anchored by means of anchor chains 23, 23*a*, these anchor chains passing through respective anchoring brackets 25, 25*a*, integrally formed at one end of main pulley brackets 18, 18*a*. The anchoring chain brackets 25, 25*a*, have appropriate slots or other openings 27, 29 for passage of the chain links of the anchor chains 23, 23*a* through the anchor brackets 25, 25*a*, and for holding the chain links to said brackets at the desired position.

Each of the main pulley brackets 18, 18*a* of the chain pulley assemblies 20, 20*a* also carry a pair of chain pulley arms or chain pulley supports 33, 33*a*, respectively. Pulley wheels 40, 40*a* are rotatably mounted between the pairs of supports 33, 33*a* by means of shaft 41 extending between each of the said pairs of supports.

Pulling chains 24, 24*a* travel through pulley chain assemblies 20, 20*a*, respectively, one end of each of the pulley chain assemblies being fastened to an automobile gripper means 28, 28*a*, the other end of each of the pulley assemblies being releasably affixed to the vertically extensible pulley head 30, as will be described. Such gripper means 28, 28*a* are affixed to a portion of the area of the vehicle 26 which is to be repaired.

The pulling chains 24, 24*a*, as well as the anchoring chains 23, are made of a series of welded metal chain links 45.

Figure 5:
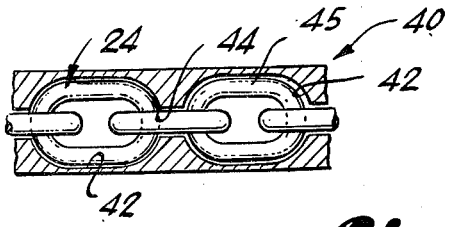
FIG. 5 is a view along line 5—5 of FIG. 2.

The chain pulley wheels 40, 40*a* have a width slightly larger than that of the width of the chain links 45 of pulling chains 24, 24*a*, and the circumferential surface 46 of each of the wheels 40, 40*a* are formed with large chambers or pockets 42 communicating with each other through narrow chain link recesses 44, the pockets 42 and recesses 44 nesting a plurality of successive chain links as the pulling chains travel through the pulley assembly 20, 20*a*. See FIGS. 2 and 5, especially in this regard.

The surface 46, pockets 42 and link recesses 44 together make up a chain track. The nesting pockets 42 and recesses 44 prevent the chains 24, 24*a* from any slippage as they travel through the pulley assemblies 20, 20*a*, respectively since they will automatically lock as they engage surfaces 46 of the pulley wheels 40, 40*a*. If the pulling chains are made slack, the pockets 42 and recesses 44 i.e., the chain track, prevent the chains 24, 24*a* from jumping out of their respective pulley assemblies 20, 20*a* and minimizes injury to the chain links 45.

The pulley assemblies 20, 20*a* are provided with identical detent assemblies 50, 50*a* respectively, which lock the pulley wheels 40, 40*a* in one direction only, i.e., prevents rotation in the counter-clockwise direction only — so as to avoid any loss of pull — even though the ram pressure has been removed.

The detent assemblies 50 are formed as follows. A series of sloping teeth 47 are integrally formed, or provided, on each side face of the pulley wheels 40, 40*a*, the spaces between the teeth providing notches 48 for a detent of the detent assembly 50. The detent assembly includes a detent handle 52, a detent shaft 54 passing through each of the supports 33, one end of which shaft 54 is fixed to detent handle 52 and the other end of which is affixed to the other end of the shaft 54 and a detent 56. The detent handle 52 and detent 56 are rotatable as a unit about shaft 54. As the handle 52 of the detent assembly is rotated about its shaft 54 (in a clockwise direction) to the position shown in FIG. 2, it will be seen that the detent 56 will engage successive notches 48, as the wheels 40, 40*a* rotates in the clockwise direction but any counterclockwise rotation of the pulley wheels 40, 40*a* is prevented. It will also be noted that the number of detent notches 48 exceeds the member of chain link chambers 42 by approximately 2:1 so that any loss of pull, if any, will be held down generally to a maximum of a fraction of an inch.

Figure 2:
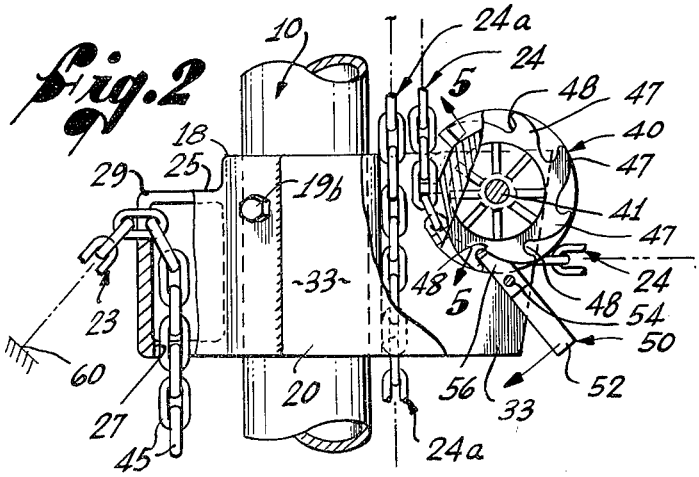
FIG. 2 is a fragmentary, enlarged, side elevational view of FIG. 1, partially in section, showing certain details of the chain pulley assembly of the improved apparatus.
Figure 3:
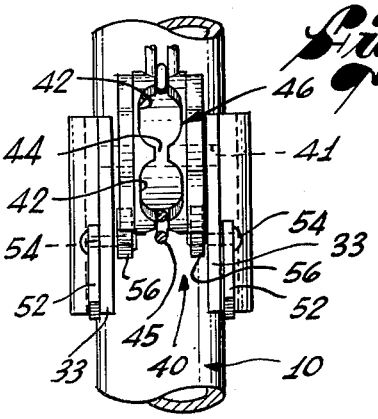
FIG. 3 is an end elevational view of FIG. 2, as viewed from the right side thereof.
Figure 4:
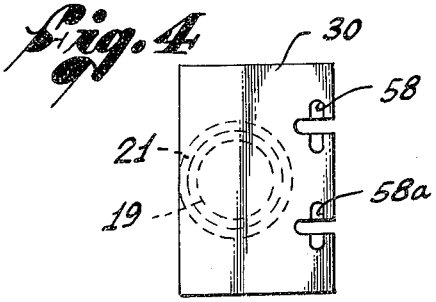
FIG. 4 is a top plan view of the pulling head (with the chains removed therefrom) the pulling head being mounted on the end of a powered ram.

In operation, the chain pulley brackets 18, 18*a*, are first fixed to anchor post 10 in a manner to achieve the optimum height and direction for each pulling chain 24, 24*a*, depending upon the desired pull. The pulling chains 24, 24*a* are then attached to the car 26 by means of the gripper means 28, 28*a* and the other ends of the chains 24, 24*a* are passed through the main chain pulley brackets 18, 18*a*, respectively. In this connection, the pulley supports or arms 33 of the upper pulley bracket 18 are longer than the pulley supports 33*a* of lower pulley brackets 18*a* so that the pulling chain 24*a* can pass through the additional space provided between the post 10 and the pulley assembly 20 adjacent the chain 24, and not be in conflict therewith, as shown in FIG. 2. In other words, the upper pulley assembly 20 is offset with respect to the lower pulley assembly 20*a* to allow upward passage of the lower chain 24*a*.

The upper ends of the pulling chains 24, 24*a* are then held taut by the pulling head 30. The pulling head 30 has a pair of cross-slots 58, 58*a* into which particular chain link 45 of the pulling chains 24, 24*a* can be held but from which it can be quickly detached. The anchoring post 10 is also additionally anchored by anchor chains 23, held taut to floor or wall anchor points 60 by rigid connections conventional in the art.

The actual repair operation can now commence by making sure the detents 56 are in the position shown in FIG. 2, allowing the ram 21 to be powered, thereby causing pulling head 30 to extend vertically upwardly. If the pulling angle of one of the pulling chains 24, 24*a* is to be adjusted before the pull is completed, the ram 21 is depressed and the desired pulley assembly is then readily movable to the different height and direction desired. The chain on the assembly not being changed is locked by its detent 56 to avoid any loss of pull; and further, the pockets 42 and link recesses 44 forming the chain track prevent the chain links 45 from jumping out of the pulley assembly not being changed.

When the pulling head 30 is completely extended (as indicated in phantom line in FIG. 1 by 19') and then returned, the cross slots 58, 58*a* in the pulling head allow fast, easy, removal of the slack in the pulling chains 24, 24*a*, and permit quick engagement of other lower chain links 45 for further pulling, if necessary. Again the pockets 42 and link recesses 44 prevent the chain link 45 from jumping out of the pulley assemblies as the slack is being removed.

After the pull has been completed but before the ram 21 is depressed, the detent handles 52 are forced in a clockwise direction, as viewed in FIG. 2, until detents 56 are removed from their detent notches 48. The pulley wheels 40, 40*a* are then free to rotate in a counterclockwise fashion to enable the pulling chains 24, 24*a* to be removed from pulley wheels 40, 40*a* as the ram 21 is released.

After disengagement of the post 10 from the floor or wall anchor points 60, the post 10 can be moved to another location by merely tipping the base plate 13 until the wheels 14 or 14*a* touch the floor, and the post 10 and associated structure can be rolled to the new position.

Modifications of the foregoing will occur to those skilled in the art. I therefore intend to be bound only by the claims which follow.

I claim:

1. Apparatus for pulling deformations from sheet metal, metal frames and the like, which comprises, in combination:

a tubular anchor post;

base means for stably mounting said anchor post on a generally flat surface;

power means mounted within said tubular anchor post and connected to a source of power;

a pulling head, operatively connected to said power means, and mounted for vertically extensible movement above said anchor post;

hook means provided on said pulling head;

at least two main chain pulley brackets releasably affixed to said anchor post;

a pulley wheel rotatably mounted within each of said main chain pulley brackets;

chain track means provided on each of said pulley wheel adapted to engage with chain links of a chain means, one end of each of said chain means adapted to be fastened to the metal to be pulled and the other end of which is adapted to be fastened to said hook means of said pulling head whereby as said pulling head is moved upwardly said chain links of each said chain means enages each of said chain track means and rotates each of said pulley wheels, each of said chain track means comprising, within the circumferential surface of each of said pulley wheels, a series of alternating link recesses and nesting chambers, said chain link recesses and said nesting chambers adapted to receive in nesting fashion successive chain links of said chain means;

a plurality of detent notches provided on at least one face of each of said pulley wheels;

a pivotally mounted detent means, said detent means, in one position engaging successive notches, as each of said pulley wheels are rotated in one direction while preventing rotational movement of said pulley wheels in the opposite direction, said detent means being disengageable from said notches thereby allowing free rotation of the pulley wheels in either direction; and each of said main chain pulley brackets being positioned at different heights on said anchor post and at desired angular directions about said anchor post, an upper one of said main chain pulley brackets carrying its pulley wheel at a point spaced farther from said anchor post than the other of said chain pulley brackets to permit a chain means, engaging a lower pulley wheel, to pass between said anchor post and said upper pulley wheel and engage with said hook means provided in said pulling head.

2. The apparatus of claim 1 wherein said base means for stably mounting said anchor post comprises:

a normally, substantially horizontal base plate affixed to said anchor post;

a pair of flanges affixed to opposed ends of said base plate, said flanges extending angularly upwardly with respect to said base plate; and a plurality of base wheels rotatably mounted onto said flanges, the lowermost point of said base wheels lying above the plane of said base plate when said base plate is in normally substantial horizontal position.

3. The apparatus of claim 1 wherein said hook means on said pulling head is provided in the form of at least one cross-slot which is engageable with any of said chain links of said chain means.

4. The apparatus of claim 1 wherein an anchor bracket means is provided on said main chain pulley bracket for anchoring said main chain pulley to rigid connections adjacent said anchor post.

5. The apparatus of claim 1 wherein the number of detent notches exceeds the number of nesting chambers.

6. The apparatus of claim 1 wherein said plurality of detent notches is provided on both sides of said pulley wheel.

* * * * *